US005891309A

United States Patent [19]

Page et al.

[11] Patent Number: 5,891,309

[45] Date of Patent: Apr. 6, 1999

[54] WEB STABILIZING DEVICE

[75] Inventors: Robert E. Page, Davis; Gerald J. Kramer, Rockton, both of Ill.; Dale A. Brown, Milton; David A. Smith, Beloit, both of Wis.

[73] Assignee: Beloit Technologies, Inc., Wilmington, Del.

[21] Appl. No.: 920,157

[22] Filed: Aug. 26, 1997

[51] Int. Cl.[6] ..... B31F 1/12; F26B 11/02

[52] U.S. Cl. ..... 162/281; 162/111; 162/207; 162/280; 162/363; 34/110; 34/122

[58] Field of Search ..... 162/111, 207, 162/272, 280, 281, 363; 34/122, 110

[56] References Cited

U.S. PATENT DOCUMENTS

| | | | |
|---|---|---|---|
| 3,065,487 | 11/1962 | Scott | 15/256.51 |
| 4,087,319 | 5/1978 | Linkletter | 162/113 |
| 4,185,399 | 1/1980 | Gladish | 34/120 |
| 4,502,231 | 3/1985 | Fissmann et al. | 34/114 |
| 4,906,333 | 3/1990 | Myren | 162/111 |
| 5,385,644 | 1/1995 | Hannus et al. | 162/207 |
| 5,466,298 | 11/1995 | Pollock | 134/15 |
| 5,512,139 | 4/1996 | Worcester | 162/111 |
| 5,577,294 | 11/1996 | Pollock | 15/345 |
| 5,621,983 | 4/1997 | Lundemann et al. | 34/641 |

OTHER PUBLICATIONS

Thermo Wisconsin Inc. sales literature for Thermo Pathmaster Web Stabilizer, Thermo Fibermaster Web Cleaner, Thermo Enviromaster Capture Hood and Thermo Threadmaster Web Threading System, .by Thermo Wisconsin, Inc., a Thermo Fibertek Company, Kaukana, Wisconsin, 6 pages.

"This is 'Not' The Solution to Your VOC Problem . . . ", brochure by Thermo Electron, 9 pages.

"Dust Management on the Paper Machine and Converting Lines", Oscar Lopez, Gregorio Moreno, Marian. Lopez, for Brunnschweiler SA, Spain, 17 pages.

"Use of Computer Modeling for Depicting Air Flows in Tissue Mills", Edwin A. Kleissler, Kleissler Co. USA, 8 pages.

"Fire Prevention in Dust Extraction Systems with Drum and Bag Filters", Bertil Weyde, President, XEDE International (Firefly en France), France, 8 pages.

*Primary Examiner*—Peter Chin
*Assistant Examiner*—Steven B. Leavitt
*Attorney, Agent, or Firm*—Raymond W. Campbell; Gerald A. Mathews

[57] ABSTRACT

A web support foil positioned adjacent to a Yankee dryer above a creping doctor. The foil supports the web as it leaves the dryer. Mounted to the top of the foil is an adjustable air deflector which is positioned tangent to the Yankee dryer. The air deflector blocks air moving along the web. A slotted opening draws air from a leading-edge pocket collecting fibers which are broken loose during the creping action. The web is held against the bottom side of the foil by one or more air jets which are directed over the bottom surface on the foil. The jets of air function as coanda air jets and prevent the web from sticking to the bottom surface of the foil while creating a Bernoulli effect which holds the web against the bottom of the foil.

24 Claims, 5 Drawing Sheets

32
22
26
60
24
46
44
52
48
40
50
42
56
32
62
65
43
63
67
70
32
64
45
30
34
20
72
47
74
75
78
80
28
49
60
44
58
62
42
40
46
52
68
70
66
32

WEB STABILIZING DEVICE

FIELD OF THE INVENTION

The present invention relates to devices for stabilizing a paper web in a papermaking machine in general, and in particular to devices for stabilizing a paper web dried on a Yankee dryer, Through Air Dryer (hereinafter referred to as TAD) or other tissue and towel making apparatus and processes including winder equipment and processes and web converting equipment and processes.

BACKGROUND OF THE INVENTION

Lightweight grades of paper which have a soft absorbing texture are formed by drying the paper web on a single large drying cylinder referred to as a Yankee dryer. The lightweight paper web, after being formed in the forming section of a papermaking machine and pressed in a press section, is dried on the surface of the Yankee dryer. The paper web is pressed on the Yankee dryer by a press roll. The Yankee dryer is heated by steam which is supplied to the interior of the Yankee dryer. An aircap placed over the top of the Yankee dryer blows high velocity heated air down onto the dryer surface to increase the drying rate of the Yankee dryer.

The paper dried on the Yankee dryer is given its characteristic absorbency by a creping action which takes place at the doctor blade which scrapes off paper from the surface of the Yankee dryer. The scraping action of the doctor blade compresses the paper about 3 to 75 percent. Lightweight grades of tissue which are produced on the Yankee dryer are fabricated at relatively high-speed. The highest speed Yankee dryers currently operate at about 6,700 feet per minute before the paper is compressed in the creping process.

The high speed at which tissue types of paper are manufactured combined with the creping action which removes the paper from the surface of the Yankee dryer produces large quantities of paper fiber dust. The dust is a fire hazard, increases maintenance costs and can contaminate the product. The dust also creates health concerns. The low strength of the tissue as it is removed from the Yankee dryer by the doctor blade and an unstable web run can create problems and lead to frequent breaks of the paper web. Increasing web tension to avoid paper breaks by increasing tension produced by the reel can result in the web being stretched which reduces its absorbency.

In existing tissue making machines the necessity of frequently cleaning and removing broke from the vicinity of the doctor blade has prevented the placement of any support sufficiently close to the doctor blade to prevent occasional paper breaks.

Skinning doctor blades positioned in front of the creping doctor have been used to deflect air from the aircap and from the air naturally moving with the paper web away from the web before it is scraped from the Yankee dryer roll, yet the effectiveness of such skinning doctor blades is limited.

What is needed is a tissue web support device which can decrease paper breaks and the amount of dust generated as a tissue web is scraped off the surface of the Yankee dryer.

SUMMARY OF THE INVENTION

A web support foil is positioned adjacent to a Yankee dryer just above the creping doctor. The foil overlies the tissue web which is being scraped off the Yankee dryer and supports the web as it leaves the dryer. Mounted to the top of the foil is an adjustable air deflector in the form of an adjustable blade which is positioned as close as practicable to the Yankee dryer. The blade blocks air from the aircap and from the boundary layer moving along with the web and deflects the air over the top of the foil.

The foil can be less than six inches thick or greater than twelve inches thick but generally is about six inches thick, and can be of varying lengths but generally has a length of two to four feet. Duct work and/or other equipment is mounted on or close to the foil, and used for dust removal. This equipment can increase the thickness of the foil. The foil is positioned parallel or substantially parallel to the tissue web as it travels away from the Yankee dryer after being scraped from the Yankee dryer by the doctor blade. The foil has a leading-edge which is opposite and spaced from the Yankee dryer. A deflector blade which is mounted to the leading-edge of the foil defines a leading-edge pocket with the Yankee dryer, the foil leading-edge, and the tissue web which is moving along the bottom of the foil. The interior of the foil is divided into a number of air exhaust boxes and air supply chambers. One air exhaust box is located directly beneath the deflector blade and has a slotted opening which draws air from the leading-edge pocket.

By drawing air from the leading-edge pocket the downward pressure on the tissue web caused by air blowing along the web surface can be controlled, and paper fibers which are broken loose during the creping action can be drawn into the air exhaust box positioned beneath the air deflection blade. This arrangement removes a major source of airborne dust which is released from the tissue web as it is being creped. The tissue paper web is held adjacent to the bottom side of the foil by one or more air jets depending on the length of the foil which are arrayed in the cross machine direction on the bottom of the foil. The first set of jets is located immediately downstream, on the bottom portion of the leading-edge of the foil. The jets are directed over the bottom surface on the foil. The jets of air function as coanda air jets and prevent the web from sticking to the bottom surface of the foil. The injected air also creates a Bernoulli affect where increasing velocity of the stream air reduces the air stream's pressure, thus creating a region of low pressure which serves to hold the web against the bottom of the foil.

Other sets of air jets are positioned along the length of the foil as needed to create the same effect described for the first set of air jets. Here the air jets are arranged in a cross machine direction and are directed parallel or substantially parallel to the bottom of the foil. The air jets may be directed in the down machine direction or angled towards the front and back of the papermaking machine to spread the tissue web in a cross machine direction.

Adjacent to the trailing edge of the foil is a second air exhaust which draws air through a plurality of holes or slots in the bottom surface of the foil which extend in a cross machine direction. The second air exhaust serves to remove additional dust from the surface of the web and hold the web against the bottom surface of the foil.

It is a feature of the present invention to reduce the amount of dust released during the creping process in the formation of a tissue paper web.

It is another feature of the present invention to provide a means for reducing the web breakage in a tissue forming papermaking machine by, among other reasons, stabilizing the web.

It is a further feature of the present invention to provide a means for supporting a tissue web as it is led away from a Yankee dryer.

It is a further feature of the present invention to provide a means for deflecting air traveling along the surface of the Yankee dryer on which a web is being dried away from the web before it is creped from the Yankee dryer by a doctor blade.

Further objects, features and advantages of the invention will be apparent from the following detailed description when taken in conjunction with the accompanying drawings.

DESCRIPTION OF THE PREFERRED EMBODIMENTS

Figures 1, 1A, 1B:
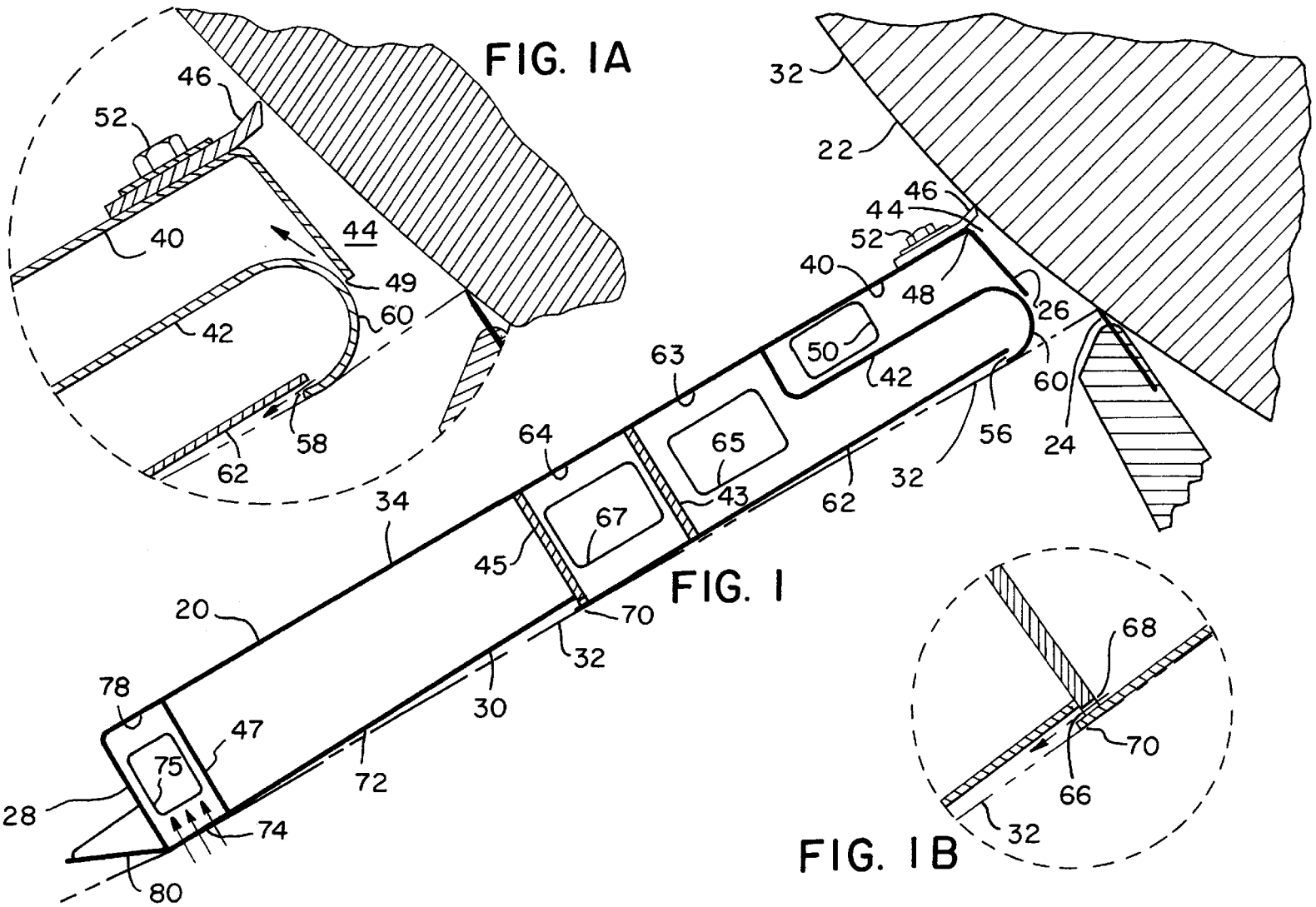
FIG. 1 is a schematic side elevational cross-sectional view of the web support foil of this invention shown in position against a portion of a Yankee dryer.
FIG. 1*a* is an enlarged detail view of the leading edge of the foil of FIG. 1.
FIG. 1*b* is an enlarged detail view of the bottom of the foil of FIG. 1.
Figure 2:
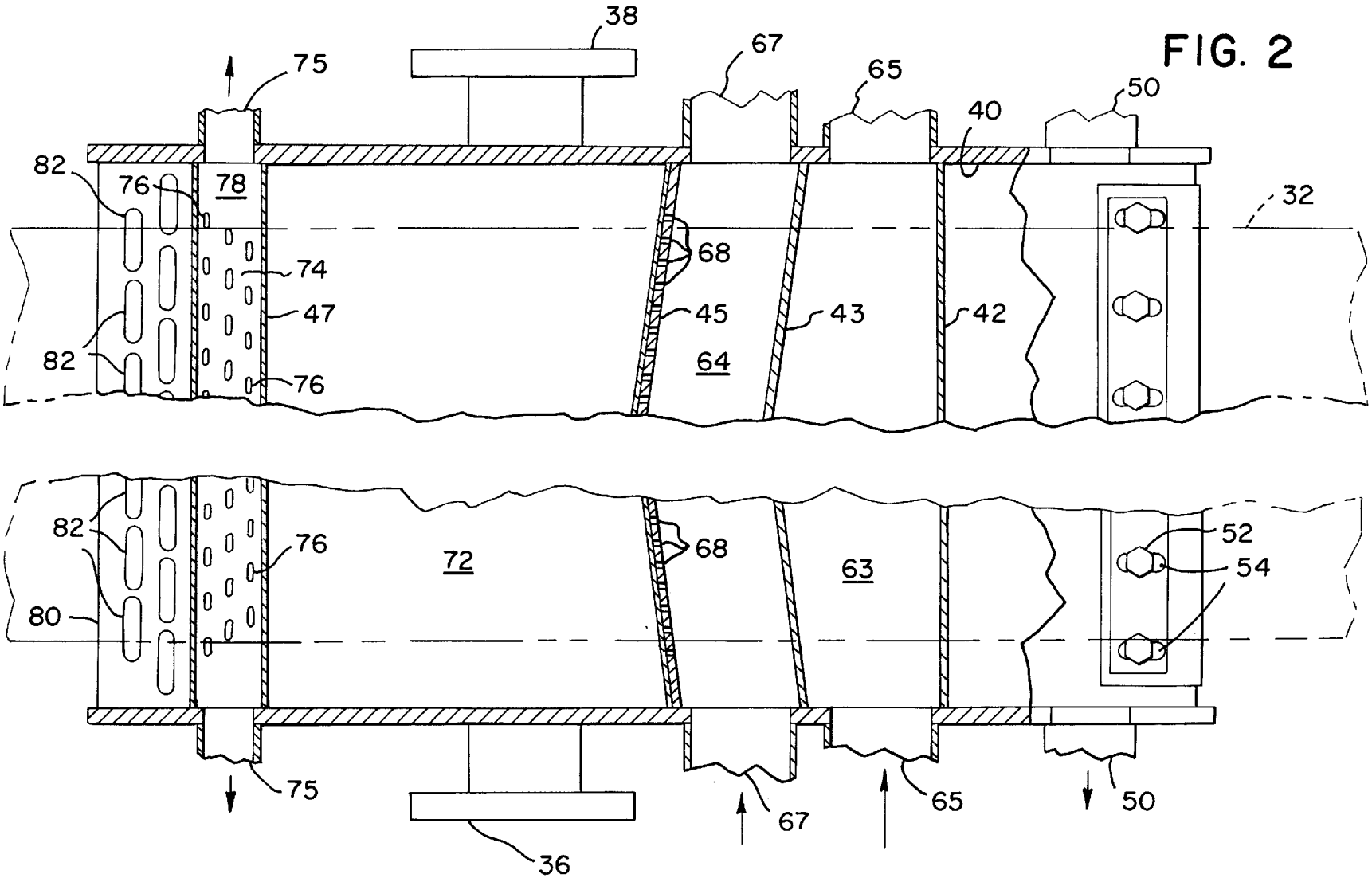
FIG. 2 is a schematic top plan view, partially cut away in section, of the web support foil of FIG. 1.

Referring more particularly to FIGS. 1–5 wherein like numbers refer to similar parts, a web support foil 20 is shown in FIG. 1. The foil 20 is positioned adjacent to a Yankee dryer roll 22 and above a creping doctor 24. The foil 20 has a leading end 26 and a trailing end 28, and a bottom surface 30 which is positioned over a paper web 32, and a top surface 34. As best shown in FIG. 2, the foil 20 extends in a cross machine direction and is mounted by flanges 36, 38. The flanges may be positioned on the machine frames (not shown) to allow vertical and horizontal motion of the foil 20. The foil may also be mounted to swing away from the Yankee dryer and the creping doctor 24 to facilitate changing the doctor blade.

The interior of the foil is defined between the leading end 26, the trailing end 28, the top surface 34, and the bottom surface 30. The interior is divided by a number of baffles 42, 43, 45, 47 into chambers which are supplied with vacuum or with pressurized air. A first vacuum chamber 40 is formed by an L-shaped baffle 42. The first vacuum chamber 40 is connected to a leading-edge pocket 44. The pocket 44 is formed between an adjustable air deflector 46 mounted on the upper leading corner 48 of the foil 20, the Yankee dryer roll 22, and the paper web 32 as it leaves the Yankee dryer 22 at the doctor blade 24. As shown in FIG. 1A, air is drawn from the pocket 44 along a slot 49 formed between the L-shaped baffle 42 and the leading end 26 of the foil. The air is drawn into the first vacuum chamber 40 by a reduced pressure in the first vacuum chamber corresponding to a vacuum of, for instance, a few inches of water.

The process of forming tissue paper is a mechanically intense process. The wet web is pressed onto the Yankee dryer roll, thereby bringing the web into intimate contact with the role surface. Yankee dryer creping aids can be applied to the web in order to control the web's adhesion to the Yankee dryer. The web adheres tightly to the surface of Yankee dryer. This adherence is necessary for good creping and heat transfer between the dryer and the web and to holding the web onto the dryer as high velocity air is blown onto the web from an aircap (not shown). Removal of the web from the surface of the Yankee dryer involves scraping the web off the surface with a doctor blade. The doctor blade not only removes the paper from the surface of the Yankee dryer, but crepes or compresses the web approximately 3 to 75 percent.

The creping action breaks some of the fiber bonds in the dried web, creating softness and absorbency of the sheet. At the same time, the creping action results in a certain percentage of the fibers breaking completely free of the web creating a dust problem. By drawing air out of the leading-edge pocket 44, a large portion of the fibers released by the creping action are drawn into the first vacuum chamber 40 and exhausted through an air duct 50. The vacuum chamber 40 should have a tapered manifold (not shown) so that the vacuum chamber does not become clogged due to areas of reduced air velocity within the chamber.

The adjustable air deflector 46 may be adjusted by means of the clamping bolts 52 and machine direction slots 54, as shown in FIG. 2, which allow the positioning of the air deflector 46 with respect to the web 32. The air deflector 46 is not actually brought into engagement with the web but is very closely spaced from the web to strip off the boundary layer air which is traveling with the web.

Ideally, the air deflector would be placed within thousandths of an inch of the web on the Yankee dryer. But practical limitations, particularly thermal expansion of the foil 20 and the air deflector 46, may require a spacing of between one-eighth and one and a half inches. The air deflector 46 should be constructed of a material which is considerably softer than the Yankee dryer surface which is invariably constructed of cast iron so that in the event the air deflector engages the Yankee dryer, the dryer would not be damaged. Typical materials for construction of the deflector 46 would include plastic, aluminum, stainless steel, composite materials and graphite. The air deflector blade also prevents air from the aircap (not shown) from impending on the web 32 as it leaves the Yankee dryer 22. The top surface 34 of the foil 20 protects the first several feet of the web 32 as it leaves the Yankee dryer from the downwash of air from the aircap (not shown).

The web 32 is guided and supported along the bottom surface 30 of the foil 20 by injecting air from a first chamber 63 formed between the L-shaped baffle 42 and the second baffle 43. As shown in FIG. 1, the injected air from a first supply duct 65 is supplied to the first chamber 63 and is forced through a slot or slots or holes 56 aligned in the cross machine direction and pointing along the bottom surface 30 of the foil 20 in a down machine direction, as shown in FIG. 1A. The air jets may be directed in the down machine direction or angled towards the front and back of the papermaking machine to spread the tissue web in a cross machine direction. The first row 58 of holes or slots 56 is positioned downstream of a cylindrical or curved lower leading edge 60 of the foil 20. Air in the first supply duct is supplied at various pressures but generally about 20 psi. The supply holes or slots 56 are positioned slightly below the surface of the cylindrical leading edge 60 and blow high velocity air along a first bottom panel 62. The blowing creates a region of low pressure due to the Bernoulli effect along the first bottom panel 62. The injected air also functions as coanda air preventing the web 32 from frictionally engaging the bottom panel 62.

As shown in FIG. 2, a second air supply chamber 64 is defined between the second baffle 43 and a third baffle 45.

The second air supply chamber 64 supplies air from a duct 67, as shown in FIG. 1B to a second row 66 of holes or slots 68 which are positioned slightly below the downstream end 70 of the first bottom panel 62 and blow over a second bottom panel 72. The function and action of the second row 66 of holes or slots 68 is similar to the first row 58 of holes 56 or slots. The second row 66 of holes or slots 68 may be directed in the down machine direction or angled towards the front and back of the papermaking machine to spread the tissue web in a cross machine direction. Again the second duct is supplied with air at various pressures but generally about 20 psi.

Following the second panel 72 is a vacuum panel 74 with a multiplicity of oblong holes 76 as shown in FIG. 2. Vacuum corresponding to a few inches of water is drawn on the vacuum panel 74 by a second exhaust chamber 78 which is connected to a duct 75. The vacuum panel serves two functions: first, holding the web 32 to the foil 20; and second, removing additional dust from the upper surface of the web. Again the design of the exhaust chamber 78 formed by the baffle 47 should include a manifold (not shown) which assures even velocity of the vacuum air to prevent the buildup of paper dust within the exhaust chamber 78.

An angled shelf 80 extends from the trailing end 28 of the foil 20. As shown in FIG. 2, large oblong holes 82 extend in the cross machine direction to break the vacuum between the foil 20 and the web 32.

Figure 3:
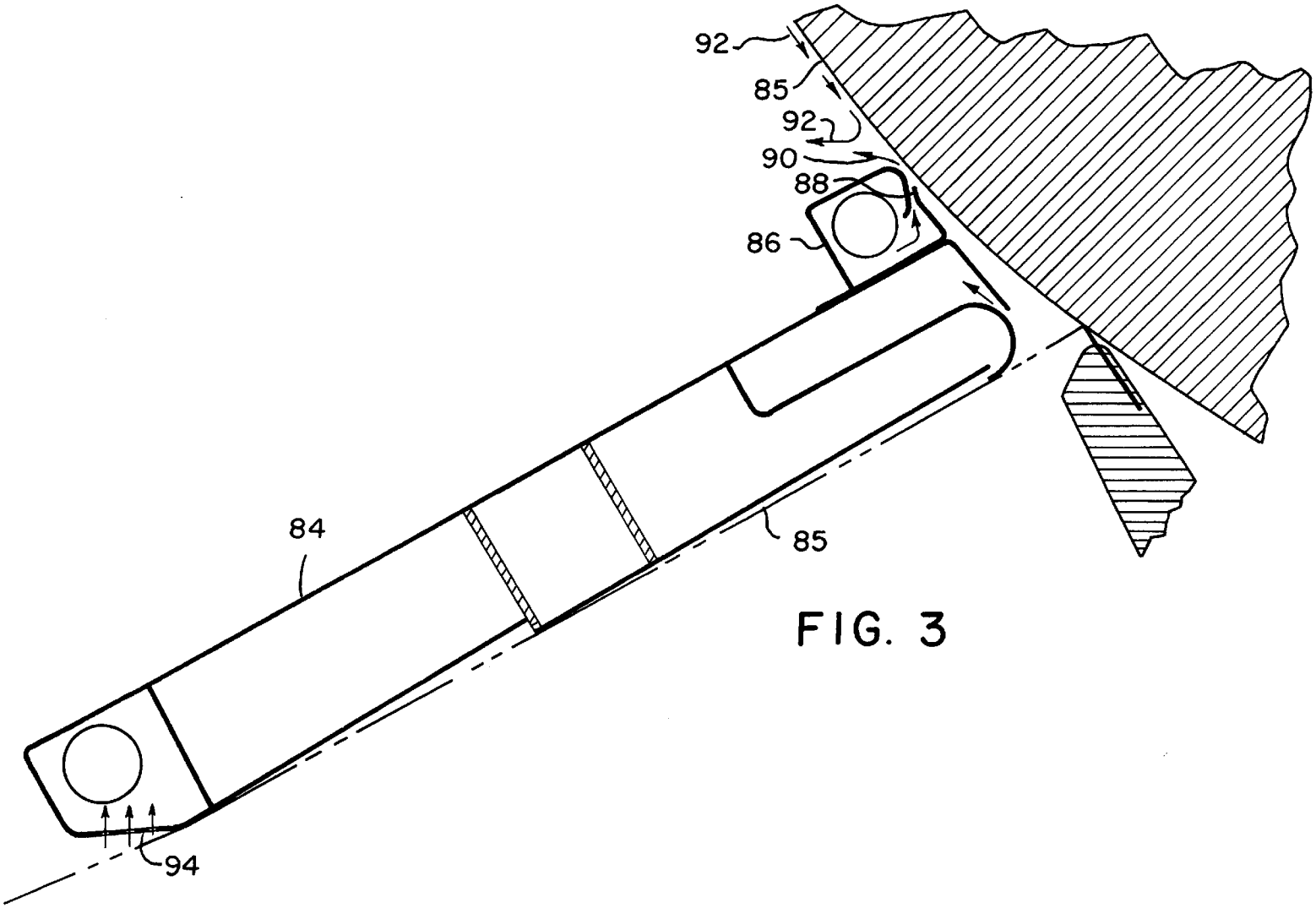
FIG. 3 is a schematic side elevational cross-sectional view of an alternative embodiment of the web support foil of FIG. 1.

An alternative embodiment foil 84 is shown in FIG. 3 which is similar to the foil 20 with the difference that the adjustable air deflector 46 is replaced by a deflection pipe 86 mounted on the top of the foil 84. The deflection pipe 86 has a slot 88 extending in the cross machine direction which is angled upwardly along the Yankee dryer towards the downwardly moving web 85. Air is supplied to the deflection pipe 86 at various pressures generally approximately 20 psi. The jet of air shown by arrows 90 functions as an air knife, stripping away the boundary air layer on the web surface as indicated by arrows 92. The alternative embodiment foil 84 also has a vacuum panel 94 which is angled away from the paper web 85 which performs the function of the angled shelf 80, including dust removal.

Figure 4:
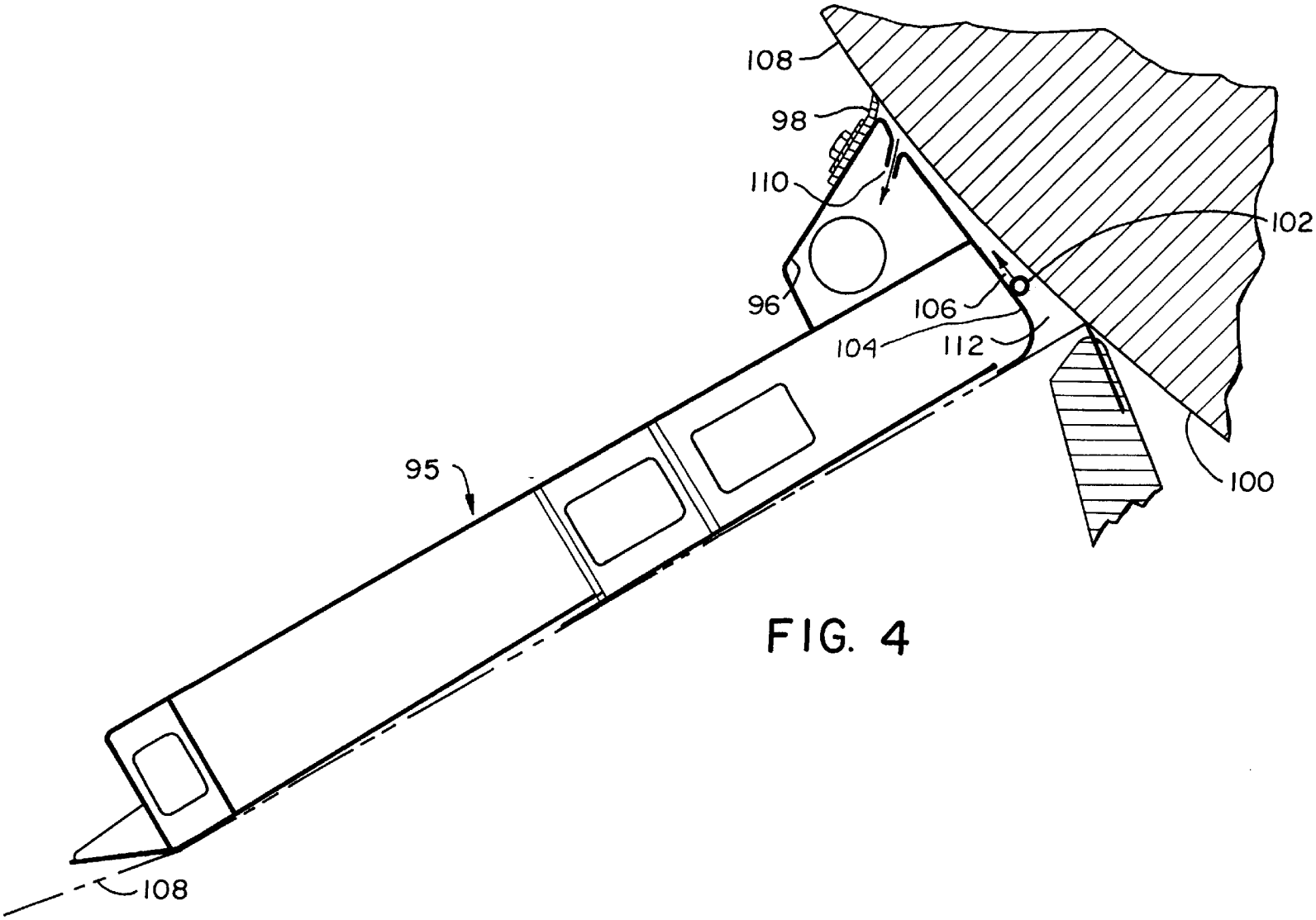
FIG. 4 is a schematic side elevational cross-sectional view of a further alternative embodiment of the web support foil of FIG. 1.

A further alternative embodiment foil 95 is shown in FIG. 4. The foil 95 is similar to the foil 20 except that an air/dust removal chamber 96 is positioned on top of the foil 95 and an adjustable air deflector 98 is positioned adjacent to the Yankee dryer 100. Because the chamber 96 is positioned above the foil 95, the L-shaped baffle 42 shown in FIG. 1 is not required. A longer cleaning area is achieved by placing a small tubular manifold 102 on the leading edge 104 of the foil 95. The tubular manifold 102 has holes (not shown) which produce jets indicated by arrows 106 which blow air along a web 108 on the Yankee dryer 100 towards an air intake slot 110 which leads to the air/dust removal chamber 96.

This design has the advantage that air is supplied to and removed from a leading edge pocket 112 and thus can be balanced preventing any tendency for air or the web 108 to be drawn into the pocket 112.

It should be understood that the arrangement of the foil 95 shown in FIG. 4 could be incorporated with the various features of the foil before shown in FIG. 3.

It should be understood that where a slot is shown, an array of holes could be used similarly, and where an array of holes is described a slot or slots could be used. Holes are preferred for manufacturing reasons whereas slots produce a more even flow of air or vacuum.

Figure 5:
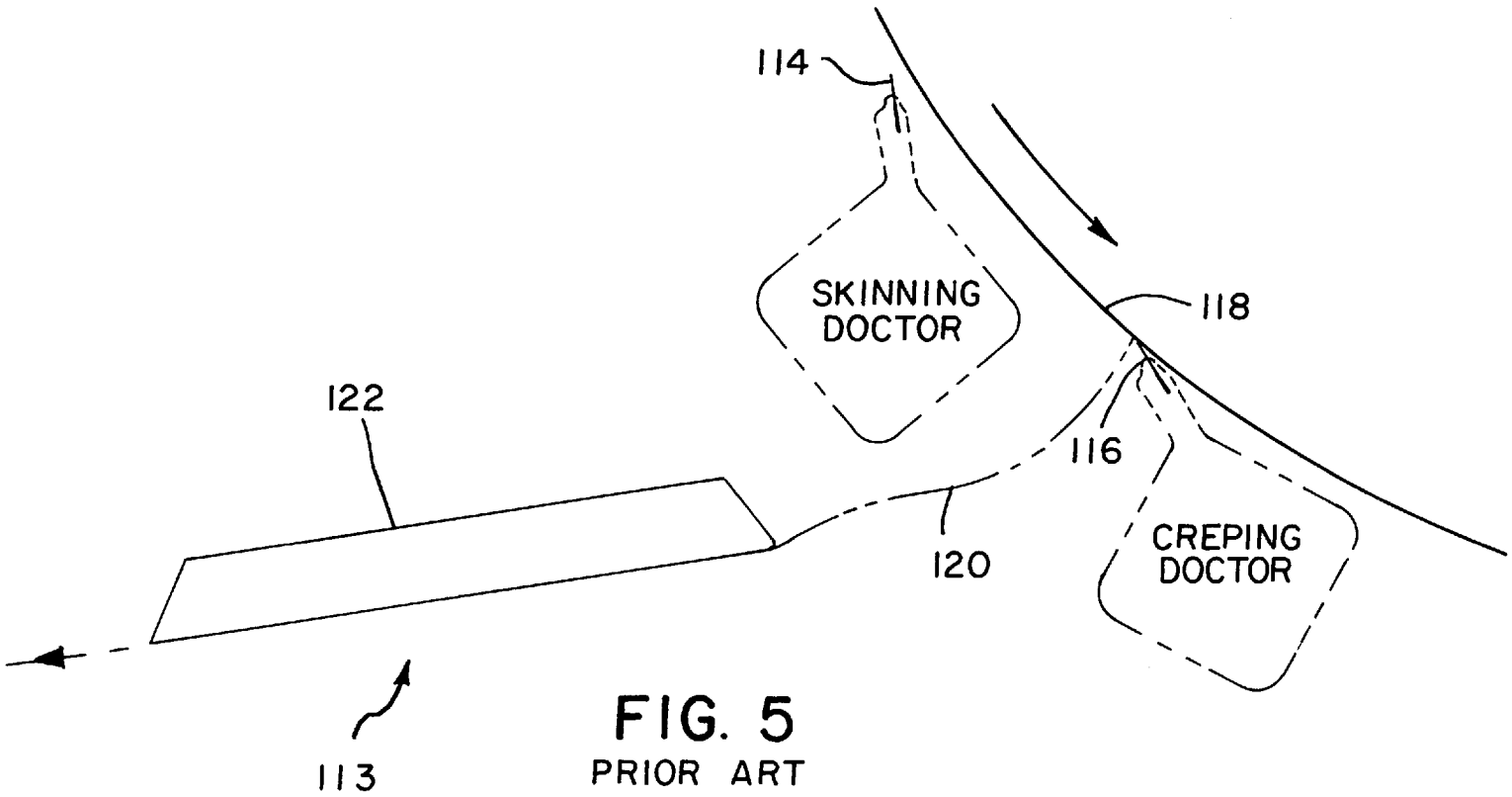
FIG. 5 PRIOR ART
FIG. 5 is a schematic side elevational view of a prior art web support foil shown positioned relative to a Yankee dryer and a doctor blade.

FIG. 5 shows a prior art configuration 113 similar to that shown in U.S. Pat. No. 5,512,139 to Worcester. The prior art design has a skinning doctor 114 and a creping doctor 116 positioned against a Yankee dryer 118. A web 120 is scraped from the Yankee dryer by the creping doctor 116. A foil 122 is positioned some distance from the Yankee dryer and picks up the web 120 spaced from the Yankee dryer 118. The function of the skinning doctor 114 is to doctor the web 120 off the Yankee dryer while the creeping doctor blade is being replaced. Thus the skinning doctor is only used when the creping doctor is not being used.

It is understood that the invention is not limited to the particular construction and arrangement of parts herein illustrated and described, but embraces such modified forms thereof as come within the scope of the following claims. For example, features described for other than the leading edge area can be applied to foils at other locations in the web run besides at the Yankee dryer, and also, on the foils for tissue machines with TAD rather than Yankee dryers.

We claim:

1. A web support foil for use in a papermaking machine comprising:

a Yankee dryer having a dryer surface;

a creping doctor blade engaging the Yankee dryer surface;

a foil body having an upper surface, a lower surface, and a leading end closely spaced from the Yankee dryer and positioned above the creping doctor blade; and an air deflector positioned on the upper surface of the foil adjacent the leading end and positioned to deflect air from a surface of a web traveling on the Yankee dryer surface.

2. The web support foil of claim 1 wherein the foil is partitioned internally to form a vacuum chamber, the vacuum chamber being connected to a source of vacuum, the foil having a means for removing air from the leading end of the foil.

3. The web support foil of claim 1 wherein a leading edge pocket is defined by the foil leading end, the air deflector, and the Yankee dryer surface, and wherein portions of the foil leading end define a slot which communicates with a chamber within the foil, the chamber being connected to a source of vacuum.

4. The web support foil of claim 1 wherein the air deflector is a blade constructed of a material softer than cast iron and is spaced from the Yankee dryer surface between one-eighth inch and one and a half inches.

5. The web support foil of claim 1 further comprising a chamber extending in the cross machine direction which communicates with a plurality of holes or slots which are positioned to blow air along the bottom surface of the foil, and wherein the plurality of holes or slots extend in the cross machine direction to support a web beneath the foil as the web travels along the bottom surface of the foil.

6. The web support foil of claim 5, wherein the plurality of holes or slots are angled in the cross machine direction to assist in spreading the web in the cross machine direction.

7. The web support foil of claim 1 wherein the air deflector is a cross-machine-direction-extending pipe which is connected to a supply of pressurized air, the pipe including at least one opening therein through which pressurized air impinges on the surface of the Yankee dryer.

8. The web support foil of claim 1 further comprising an air manifold positioned between the leading end of the foil and the Yankee dryer, wherein at least one jet of air emanates from the air manifold directed between the foil leading end and the Yankee dryer surface towards the air deflector.

9. The web support foil of claim 1 wherein the foil has a portion of the lower surface adjacent to a trailing end opposite the leading end, the portion having a multiplicity of holes or slots extending in the cross machine direction the holes or slots being in communication with a chamber formed by the foil which communicates with a source of vacuum.

10. The web support foil of claim 1 wherein the lower surface of the foil is formed by three overlapping panels forming two steps in the bottom surface of the foil and wherein openings are formed along the steps for the passage of high velocity air along the bottom of the foil.

11. A foil for supporting a tissue web as it leaves the surface of a Yankee dryer, the foil comprising:

a foil body having an upper surface, a lower surface, a leading end and a trailing end;

an air deflector blade adjustably positioned on the upper surface of the foil adjacent the leading end, and positioned to deflect air from a surface of a web traveling on a Yankee dryer surface;

a means positioned in the cross machine direction along the leading end of the foil for drawing dust formed in a creping process into the foil and away from a region immediately adjacent to the leading end of the foil; and a means positioned along the bottom of the foil for attracting a paper web to the bottom of the foil.

12. The web support foil of claim 11 wherein the foil is partitioned internally to form a vacuum chamber, the vacuum chamber being connected to a source of vacuum, the foil having a slot opening to the vacuum chamber forming the means for drawing dust formed in the creping process into the foil.

13. The web support foil of claim 11 wherein the air deflector blade is constructed of a material softer than cast iron.

14. The web support foil of claim 11 wherein the means for attracting a paper web to the bottom of the foil comprises a chamber extending in the cross machine direction which communicates with a plurality of holes or slots which are positioned to blow air along the bottom surface of the foil, and wherein the plurality of holes or slots extend in the cross machine direction to support a web beneath the foil as the web travels along the lower surface of the foil.

15. The web support foil of claim 14, wherein the plurality of holes or slots are angled in the cross machine direction to assist in spreading the web in the cross machine direction.

16. The web support foil of claim 11 further comprising an air manifold positioned in front of the leading end of the foil and the Yankee dryer, wherein at least one jet of air emanates from the air manifold and is directed between the foil leading end and the Yankee dryer surface, towards the air deflector.

17. The web support foil of claim 11 wherein the foil has a portion of the lower surface adjacent to a trailing end, opposite the leading end, the portion having a multiplicity of holes or slots extending in the cross machine direction the holes or slots being in communication with a chamber formed by the foil which communicates with a source of vacuum.

18. The web support foil of claim 11 wherein the lower surface of the foil is formed by three overlapping panels forming two steps in the lower surface of the foil and wherein openings are formed along the steps for passage of high velocity air along the lower surface of the foil thus forming the means for attracting a paper web to the lower surface of the foil.

19. A foil for supporting a tissue web as it leaves a Yankee dryer comprising:

a Yankee dryer having a drying surface;

a creping doctor engaging the drying surface;

a foil positioned adjacent to the Yankee dryer immediately above the creping doctor;

wherein the foil overlies a tissue web which is being scraped off the Yankee dryer, drying surface, the foil supporting the web as it leaves the dryer;

an air deflector mounted to the top of the foil the air deflector extending in the cross machine direction adjacent to and tangent the drying surface of the Yankee dryer the air deflector deflecting air flowing parallel to the web before it passes between the foil and the Yankee dryer;

a leading-edge pocket defined between the Yankee dryer, the foil, and the tissue web which is overlain by the foil;

wherein the interior of the foil is divided into a plurality of air exhaust boxes and air supply chambers;

one of said air exhaust boxes located directly beneath the air deflector and connected with a slotted opening which draws air from the leading-edge pocket;

a first bottom portion of the foil forming at least one opening connected to one of the air supply chambers, and forming a jet of air directed over a bottom surface on the foil, the jet for holding the web against the bottom of the foil.

20. The web support foil of claim 19 wherein the air deflector is a blade constructed of a material softer than cast iron and is spaced from the Yankee dryer surface between one-eighth inch and one inch.

21. The web support foil of claim 19 wherein the air deflector is a cross-machine-direction-extending pipe which is connected to a supply of pressurized air, the pipe including at least one opening therein through which pressurized air impinges on the web on the surface of the Yankee dryer.

22. The web support foil of claim 19 further comprising an air manifold positioned between the foil and the Yankee dryer, wherein at least one jet of air emanates from the air manifold and is directed between the foil and the Yankee dryer surface towards the air deflector.

23. The web support foil of claim 19 wherein the foil has a portion of the lower surface adjacent to a trailing end opposite the leading end, the portion having a multiplicity of holes extending in the cross machine direction the holes being in communication with one of said plurality of air exhaust boxes.

24. The web support foil of claim 23, wherein the multiplicity of holes are angled in the cross-machine direction to assist in spreading the web in the cross-machine direction.

* * * * *